US009785111B2

(12) United States Patent
Suzuki

(10) Patent No.: US 9,785,111 B2
(45) Date of Patent: Oct. 10, 2017

(54) IMAGE FORMING APPARATUS AND METHOD FOR CONTROLLING AN IMAGE FORMING APPARATUS

(71) Applicant: Brother Kogyo Kabushiki Kaisha, Nagoya-shi, Aichi-ken (JP)

(72) Inventor: Satoru Suzuki, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/223,039

(22) Filed: Jul. 29, 2016

(65) Prior Publication Data

US 2017/0031314 A1 Feb. 2, 2017

(30) Foreign Application Priority Data

Jul. 31, 2015 (JP) ..... 2015-151781

(51) Int. Cl.

| | |
|---|---|
| ***G03G 15/00*** | (2006.01) |
| ***G03G 21/20*** | (2006.01) |
| *G03G 15/02* | (2006.01) |
| *G03G 15/06* | (2006.01) |

(52) U.S. Cl.

CPC ..... *G03G 21/203* (2013.01); *G03G 15/0266* (2013.01); *G03G 15/065* (2013.01); *G03G 15/50* (2013.01); *G03G 15/5008* (2013.01)

(58) Field of Classification Search

CPC ..... G03G 21/203

See application file for complete search history.

(56) References Cited

U.S. PATENT DOCUMENTS 5,148,218 A * 9/1992 Nakane ..... G03G 15/5045 340/604

2016/0320733 A1* 11/2016 Kubo ..... G03G 15/065

FOREIGN PATENT DOCUMENTS

| | | | |
|---|---|---|---|
| JP | 2001-166573 A | | 6/2001 |
| JP | 2006235103 A | * | 9/2006 |
| JP | 2008015397 A | * | 1/2008 |

* cited by examiner

*Primary Examiner* — Ryan Walsh

(74) *Attorney, Agent, or Firm* — Banner & Witcoff, Ltd.

(57) ABSTRACT

An image forming apparatus, including a photosensitive member, a charger configured to charge the photosensitive member, a developer roller configured to contact the photosensitive member and supply a developer agent to the photosensitive member, a humidity sensor configured to detect humidity, and a controller is provided. The controller is configured to a voltage-application controlling process, in which the controller controls the photosensitive member and the developer roller to rotate, applies a charger-voltage to the charger, and applies a developer-voltage to the developer roller. In the voltage-application controlling process, the controller controls a voltage difference between the charger-voltage and the developer-voltage based on a peripheral velocity ratio of the developer roller with respect to the photosensitive member and the humidity.

20 Claims, 11 Drawing Sheets

FIG. 6A

HIGHER PERIPHERAL VELOCITY RATIO(Vg-Vb)

| HUMIDITY [%] | TEMPERATURE T [°C] | | | | | | | |
|---|---|---|---|---|---|---|---|---|
| | T < 10 | 10 ≦ T < 15 | 15 ≦ T < 20 | 20 ≦ T < 25 | 25 ≦ T < 30 | 30 ≦ T < 35 | 35 ≦ T < 40 | 40 ≦ T |
| H < 10 | ΔV21 | ΔV21 | ΔV22 | ΔV23 | ΔV23 | ΔV23 | ΔV23 | ΔV23 |
| 10 ≦ H < 20 | ΔV21 | ΔV21 | ΔV22 | ΔV23 | ΔV23 | ΔV23 | ΔV23 | ΔV23 |
| 20 ≦ H < 30 | ΔV21 | ΔV21 | ΔV22 | ΔV23 | ΔV23 | ΔV23 | ΔV23 | ΔV23 |
| 30 ≦ H < 40 | ΔV21 | ΔV21 | ΔV22 | ΔV23 | ΔV23 | ΔV23 | ΔV23 | ΔV23 |
| 40 ≦ H < 50 | ΔV21 | ΔV21 | ΔV22 | ΔV23 | ΔV23 | ΔV23 | ΔV23 | ΔV23 |
| 50 ≦ H < 60 | ΔV21 | ΔV21 | ΔV22 | ΔV23 | ΔV23 | ΔV23 | ΔV23 | ΔV23 |
| 60 ≦ H < 70 | ΔV21 | ΔV21 | ΔV22 | ΔV23 | ΔV23 | ΔV23 | ΔV23 | ΔV23 |
| 70 ≦ H < 80 | ΔV21 | ΔV21 | ΔV22 | ΔV23 | ΔV23 | ΔV23 | ΔV23 | ΔV23 |
| 80 ≦ H | ΔV21 | ΔV21 | ΔV22 | ΔV23 | ΔV23 | ΔV23 | ΔV23 | ΔV23 |

FIG. 6B

LOWER PERIPHERAL VELOCITY RATIO(Vg-Vb)

| HUMIDITY [%] | TEMPERATURE T [°C] | | | | | | | |
|---|---|---|---|---|---|---|---|---|
| | T < 10 | 10 ≦ T < 15 | 15 ≦ T < 20 | 20 ≦ T < 25 | 25 ≦ T < 30 | 30 ≦ T < 35 | 35 ≦ T < 40 | 40 ≦ T |
| H < 10 | ΔV15 | ΔV15 | ΔV15 | ΔV15 | ΔV15 | ΔV15 | ΔV15 | ΔV15 |
| 10 ≦ H < 20 | ΔV15 | ΔV15 | ΔV15 | ΔV15 | ΔV15 | ΔV15 | ΔV15 | ΔV15 |
| 20 ≦ H < 30 | ΔV15 | ΔV15 | ΔV15 | ΔV15 | ΔV15 | ΔV15 | ΔV15 | ΔV15 |
| 30 ≦ H < 40 | ΔV14 | ΔV14 | ΔV14 | ΔV14 | ΔV14 | ΔV14 | ΔV14 | ΔV14 |
| 40 ≦ H < 50 | ΔV14 | ΔV14 | ΔV14 | ΔV14 | ΔV14 | ΔV14 | ΔV14 | ΔV14 |
| 50 ≦ H < 60 | ΔV14 | ΔV14 | ΔV14 | ΔV14 | ΔV14 | ΔV13 | ΔV13 | ΔV13 |
| 60 ≦ H < 70 | ΔV14 | ΔV14 | ΔV14 | ΔV13 | ΔV13 | ΔV13 | ΔV12 | ΔV12 |
| 70 ≦ H < 80 | ΔV14 | ΔV13 | ΔV13 | ΔV12 | ΔV12 | ΔV11 | ΔV11 | ΔV11 |
| 80 ≦ H | ΔV13 | ΔV12 | ΔV12 | ΔV12 | ΔV12 | ΔV11 | ΔV11 | ΔV11 |

FIG. 7A

HIGHER PERIPHERAL VELOCITY RATIO(Vg)

| HUMIDITY [%] | TEMPERATURE T [°C] | | | | | | | |
|---|---|---|---|---|---|---|---|---|
| | T < 10 | 10 ≦ T < 15 | 15 ≦ T < 20 | 20 ≦ T < 25 | 25 ≦ T < 30 | 30 ≦ T < 35 | 35 ≦ T < 40 | 40 ≦ T |
| H < 10 | Vg3 | Vg3 | Vg3 | Vg3 | Vg3 | Vg3 | Vg3 | Vg3 |
| 10 ≦ H < 20 | Vg3 | Vg3 | Vg3 | Vg3 | Vg3 | Vg3 | Vg3 | Vg3 |
| 20 ≦ H < 30 | Vg3 | Vg3 | Vg3 | Vg3 | Vg3 | Vg3 | Vg3 | Vg3 |
| 30 ≦ H < 40 | Vg3 | Vg3 | Vg3 | Vg3 | Vg3 | Vg3 | Vg3 | Vg3 |
| 40 ≦ H < 50 | Vg3 | Vg3 | Vg3 | Vg3 | Vg3 | Vg3 | Vg3 | Vg3 |
| 50 ≦ H < 60 | Vg3 | Vg3 | Vg3 | Vg3 | Vg3 | Vg3 | Vg3 | Vg3 |
| 60 ≦ H < 70 | Vg3 | Vg3 | Vg3 | Vg3 | Vg3 | Vg3 | Vg3 | Vg3 |
| 70 ≦ H < 80 | Vg3 | Vg3 | Vg3 | Vg3 | Vg3 | Vg3 | Vg3 | Vg3 |
| 80 ≦ H | Vg3 | Vg3 | Vg3 | Vg3 | Vg3 | Vg3 | Vg3 | Vg3 |

FIG. 7B

LOWER PERIPHERAL VELOCITY RATIO(Vg)

| HUMIDITY [%] | TEMPERATURE T [°C] | | | | | | | |
|---|---|---|---|---|---|---|---|---|
| | T < 10 | 10 ≦ T < 15 | 15 ≦ T < 20 | 20 ≦ T < 25 | 25 ≦ T < 30 | 30 ≦ T < 35 | 35 ≦ T < 40 | 40 ≦ T |
| H < 10 | Vg3 | Vg3 | Vg3 | Vg3 | Vg3 | Vg3 | Vg3 | Vg3 |
| 10 ≦ H < 20 | Vg3 | Vg3 | Vg3 | Vg3 | Vg3 | Vg3 | Vg3 | Vg3 |
| 20 ≦ H < 30 | Vg3 | Vg3 | Vg3 | Vg3 | Vg3 | Vg3 | Vg3 | Vg3 |
| 30 ≦ H < 40 | Vg3 | Vg3 | Vg3 | Vg3 | Vg3 | Vg3 | Vg3 | Vg3 |
| 40 ≦ H < 50 | Vg3 | Vg3 | Vg3 | Vg3 | Vg3 | Vg3 | Vg3 | Vg3 |
| 50 ≦ H < 60 | Vg3 | Vg3 | Vg3 | Vg3 | Vg3 | Vg2 | Vg2 | Vg2 |
| 60 ≦ H < 70 | Vg3 | Vg3 | Vg3 | Vg2 | Vg2 | Vg2 | Vg2 | Vg2 |
| 70 ≦ H < 80 | Vg3 | Vg2 | Vg2 | Vg2 | Vg2 | Vg1 | Vg1 | Vg1 |
| 80 ≦ H | Vg2 | Vg2 | Vg2 | Vg2 | Vg2 | Vg1 | Vg1 | Vg1 |

FIG. 8A

HIGHER PERIPHERAL VELOCITY RATIO(Vb)

| HUMIDITY [%] | TEMPERATURE T [°C] | | | | | | | |
|---|---|---|---|---|---|---|---|---|
| | T < 10 | 10 ≦ T < 15 | 15 ≦ T < 20 | 20 ≦ T < 25 | 25 ≦ T < 30 | 30 ≦ T < 35 | 35 ≦ T < 40 | 40 ≦ T |
| H < 10 | Vb6 | Vb6 | Vb5 | Vb4 | Vb4 | Vb4 | Vb4 | Vb4 |
| 10 ≦ H < 20 | Vb6 | Vb6 | Vb5 | Vb4 | Vb4 | Vb4 | Vb4 | Vb4 |
| 20 ≦ H < 30 | Vb6 | Vb6 | Vb5 | Vb4 | Vb4 | Vb4 | Vb4 | Vb4 |
| 30 ≦ H < 40 | Vb6 | Vb6 | Vb5 | Vb4 | Vb4 | Vb4 | Vb4 | Vb4 |
| 40 ≦ H < 50 | Vb6 | Vb6 | Vb5 | Vb4 | Vb4 | Vb4 | Vb4 | Vb4 |
| 50 ≦ H < 60 | Vb6 | Vb6 | Vb5 | Vb4 | Vb4 | Vb4 | Vb4 | Vb4 |
| 60 ≦ H < 70 | Vb6 | Vb6 | Vb5 | Vb4 | Vb4 | Vb4 | Vb4 | Vb4 |
| 70 ≦ H < 80 | Vb6 | Vb6 | Vb5 | Vb4 | Vb4 | Vb4 | Vb4 | Vb4 |
| 80 ≦ H | Vb6 | Vb6 | Vb5 | Vb4 | Vb4 | Vb4 | Vb4 | Vb4 |

FIG. 8B

LOWER PERIPHERAL VELOCITY RATIO(Vb)

| HUMIDITY [%] | TEMPERATURE T [°C] | | | | | | | |
|---|---|---|---|---|---|---|---|---|
| | T < 10 | 10 ≦ T < 15 | 15 ≦ T < 20 | 20 ≦ T < 25 | 25 ≦ T < 30 | 30 ≦ T < 35 | 35 ≦ T < 40 | 40 ≦ T |
| H < 10 | Vb1 | Vb1 | Vb1 | Vb1 | Vb1 | Vb1 | Vb1 | Vb1 |
| 10 ≦ H < 20 | Vb1 | Vb1 | Vb1 | Vb1 | Vb1 | Vb1 | Vb1 | Vb1 |
| 20 ≦ H < 30 | Vb1 | Vb1 | Vb1 | Vb1 | Vb1 | Vb1 | Vb1 | Vb1 |
| 30 ≦ H < 40 | Vb2 | Vb2 | Vb2 | Vb2 | Vb2 | Vb2 | Vb2 | Vb2 |
| 40 ≦ H < 50 | Vb2 | Vb2 | Vb2 | Vb2 | Vb2 | Vb2 | Vb2 | Vb2 |
| 50 ≦ H < 60 | Vb2 | Vb2 | Vb2 | Vb2 | Vb2 | Vb2 | Vb2 | Vb2 |
| 60 ≦ H < 70 | Vb2 | Vb2 | Vb2 | Vb2 | Vb2 | Vb2 | Vb3 | Vb3 |
| 70 ≦ H < 80 | Vb2 | Vb2 | Vb2 | Vb3 | Vb3 | Vb3 | Vb3 | Vb3 |
| 80 ≦ H | Vb2 | Vb3 | Vb3 | Vb3 | Vb3 | Vb3 | Vb3 | Vb3 |

IMAGE FORMING APPARATUS AND METHOD FOR CONTROLLING AN IMAGE FORMING APPARATUS

CROSS-REFERENCE TO RELATED APPLICATION

This application claims priority under 35 U.S.C. §119 from Japanese Patent Application No. 2015-151781, filed on Jul. 31, 2015. The entire subject matter of the application is incorporated herein by reference.

BACKGROUND

Technical Field

The following description is related to an aspect of an image forming apparatus having a controller, which may control voltages to be applied to a charger and a developer roller, and peripheral velocity ratios of the developer roller with respect to a photosensitive member. The following description is further related an aspect of a controlling method for controlling the image forming apparatus by the controller.

Related Art

An image forming apparatus, having a charger to charge a photosensitive member and a developer roller to supply a developer agent to exposed areas of the photosensitive member, is known. In the image forming apparatus, a voltage difference between a charger voltage, which is a voltage to be applied the charger, and a developer-voltage, which is a voltage to be applied to the developer roller, may be controlled to be smaller than a predetermined reference value when the image forming apparatus is not forming an image so that undesirable adherence of a developer agent to the photosensitive may be restrained. In particular, adherence of the developer agent to unexposed areas, which should not be exposed during exposure and should keep the developer agent off, of the photosensitive member should be restrained.

SUMMARY

It was noted by the inventor of the present disclosure that adherence of the developer agent to the unexposed areas in the photosensitive member may be affected by several factors such as a peripheral velocity ratio of the developer roller with respect to the photosensitive member and an environmental condition including humidity. However, these factors may not have been taken into consideration in the control of the voltage difference between the charger voltage and the developer-voltage. Therefore, for example, when the peripheral velocity ratio is changed, and/or humidity changes, the applied voltage difference may not match with a preferable value or may not provide the effect to avoid the adherence of the developer agent to the unexposed areas.

The present disclosure is advantageous in that an image forming apparatus and a controlling method, by which adherence of a developer agent to unexposed areas of the photosensitive member may be controlled over different conditions, such as peripheral velocity ratios and humidity, are provided.

According to an aspect of the present disclosure, an image forming apparatus including a photosensitive member; a charger configured to charge the photosensitive member; a developer roller configured to contact the photosensitive member and supply a developer agent to the photosensitive member; a humidity sensor configured to detect humidity; and a controller, is provided. The controller is configured to execute a voltage-application controlling process, in which the controller controls the photosensitive member and the developer roller to rotate, applies a charger-voltage to the charger, and applies a developer-voltage to the developer roller. In the voltage-application controlling process, the controller controls a voltage difference between the charger-voltage and the developer-voltage based on a peripheral velocity ratio of the developer roller with respect to the photosensitive member and the humidity.

According to another aspect of the present disclosure, a method to control voltage application in an image forming apparatus including a photosensitive member, a charger configured to charge the photosensitive member, and a developer roller configured to contact the photosensitive member and supply a developer agent to the photosensitive member, is provided. The method includes controlling the photosensitive member and the developer roller to rotate; and controlling voltage application of a charger-voltage to the charger and a developer-voltage to the developer roller. During the control of the voltage application, a voltage difference between the charger-voltage and the developer-voltage is controlled based on a peripheral velocity ratio of the developer roller with respect to the photosensitive member and the humidity.

BRIEF DESCRIPTION OF THE ACCOMPANYING DRAWINGS

FIGS. 6A, 6B are tables respectively indicating voltage differences associated with temperatures and humidity when the peripheral velocity ratio is higher (FIG. 6A) and lower (FIG. 6B) in the laser printer according to the exemplary embodiment of the present disclosure.

FIGS. 7A, 7B are a first charger table and a second charger table respectively indicating charger voltages to be applied to a charger when the peripheral velocity ratio is higher (FIG. 7A) and lower (FIG. 7B) in the laser printer according to the exemplary embodiment of the present disclosure.

FIGS. 8A, 8B are a first developer table and a second developer table respectively indicating developer-voltages to be applied to a developer roller when the peripheral velocity ratio is higher (FIG. 8A) and lower (FIG. 8B) in the laser printer according to the exemplary embodiment of the present disclosure.

DETAILED DESCRIPTION

Figure 1:
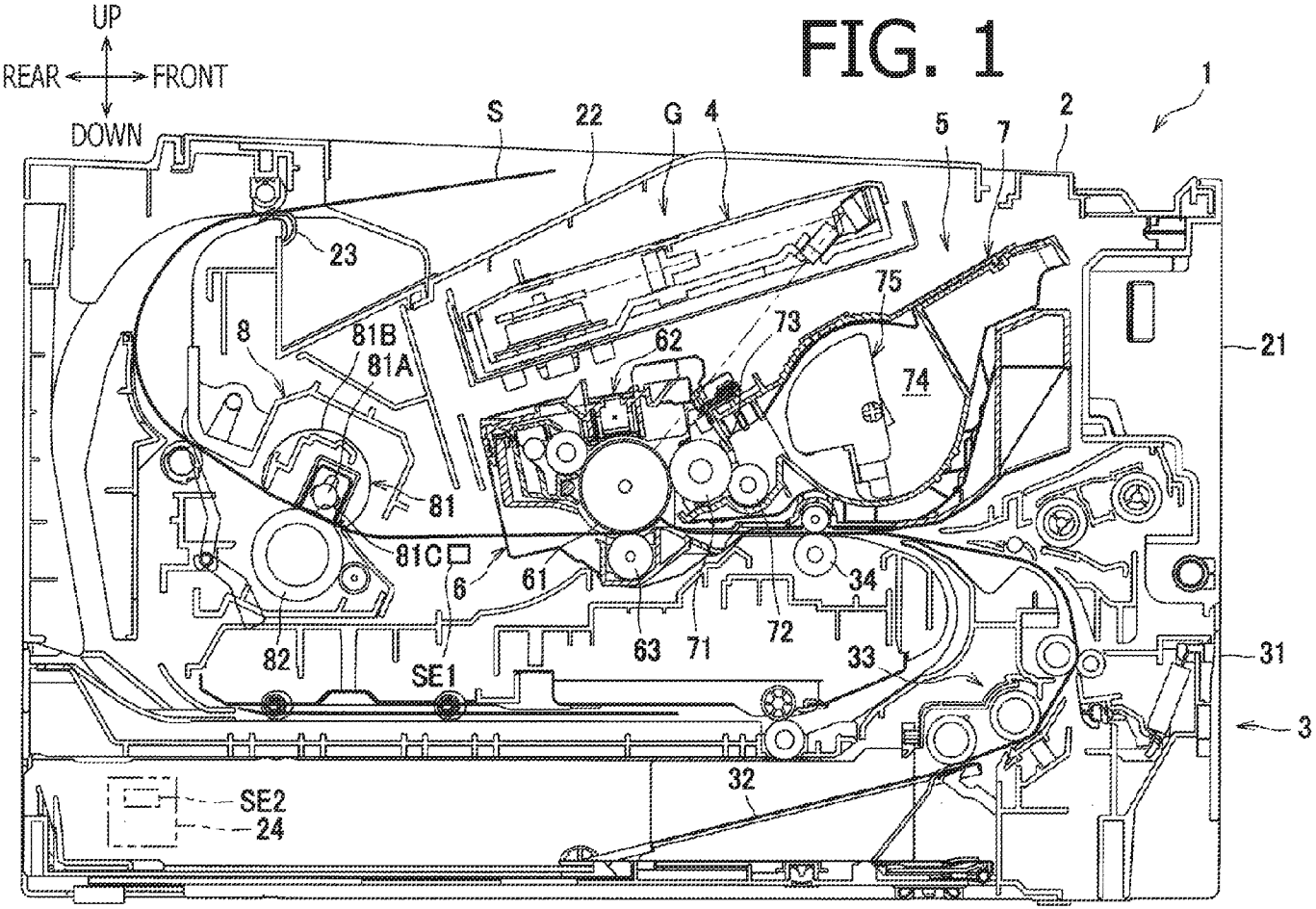
FIG. 1 is an illustrative cross-sectional side view of a laser printer according to an exemplary embodiment of the present disclosure.
Figure 2:
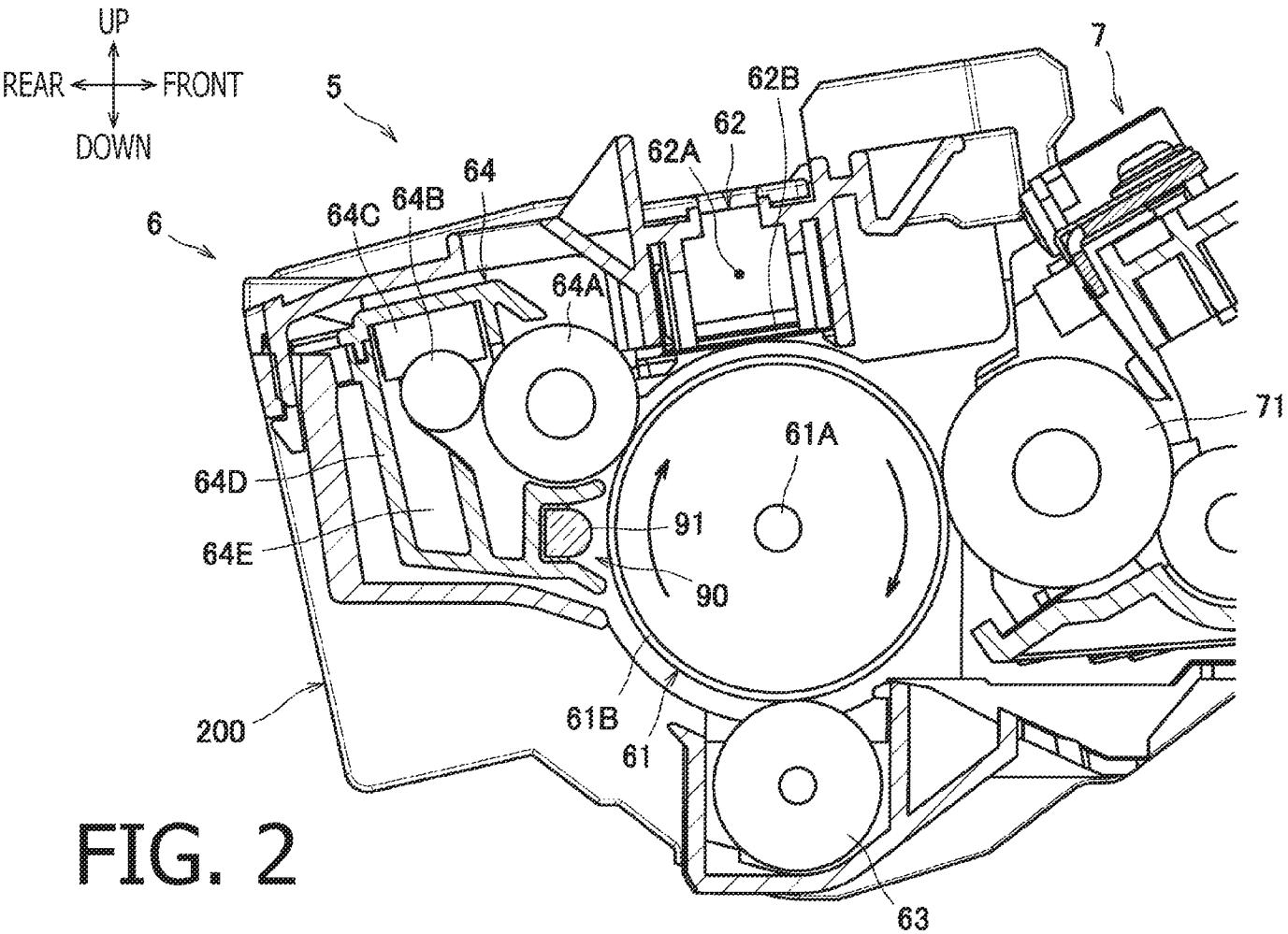
FIG. 2 is a cross-sectional view of a rear part of a processor cartridge in the laser printer according to the exemplary embodiment of the present disclosure.
Figure 3:
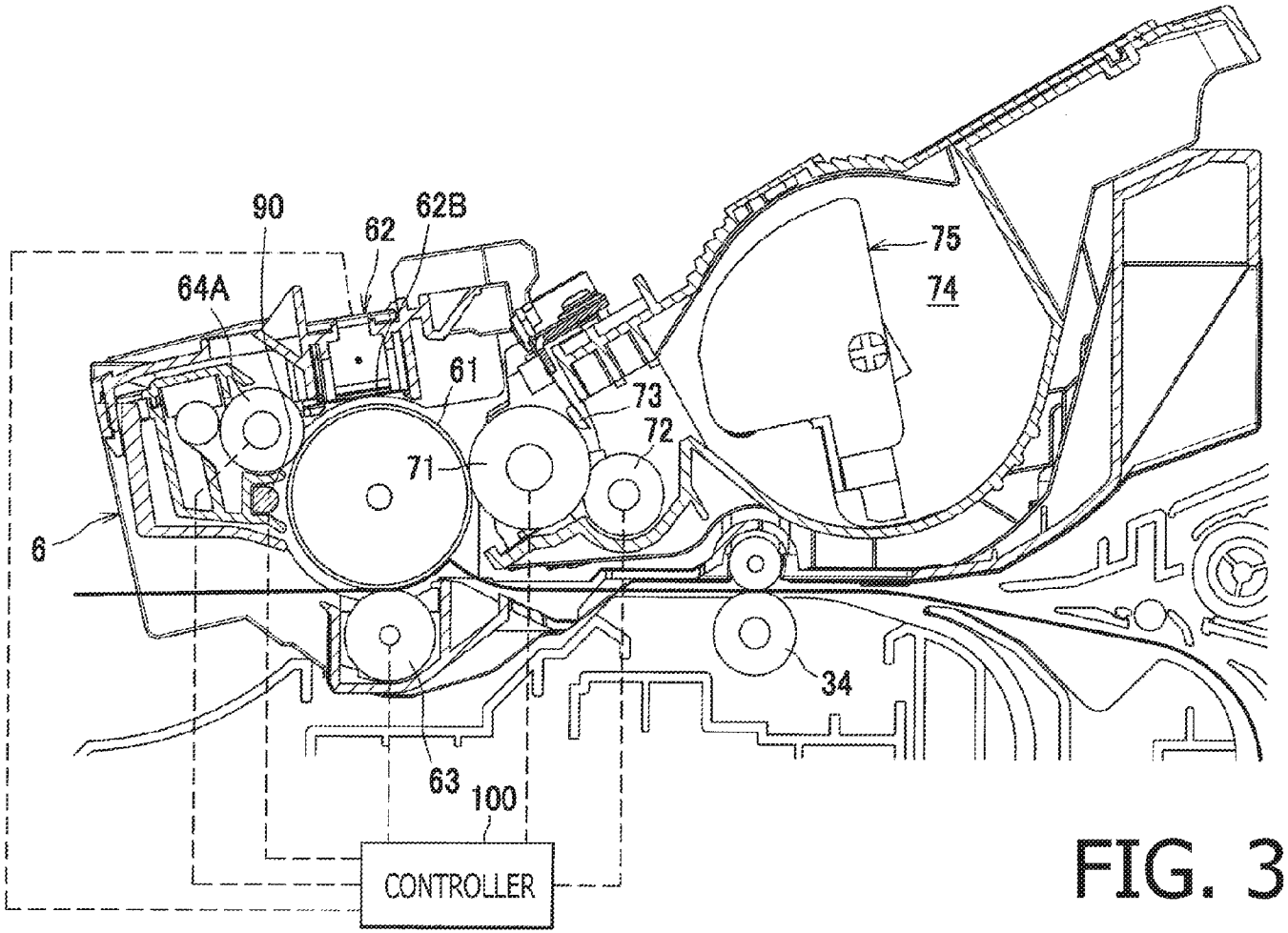
FIG. 3 is an illustrative view of a controller and devices, to which voltages controlled by the controller are applied, in the laser printer according to the exemplary embodiment of the present disclosure.
Figure 4:
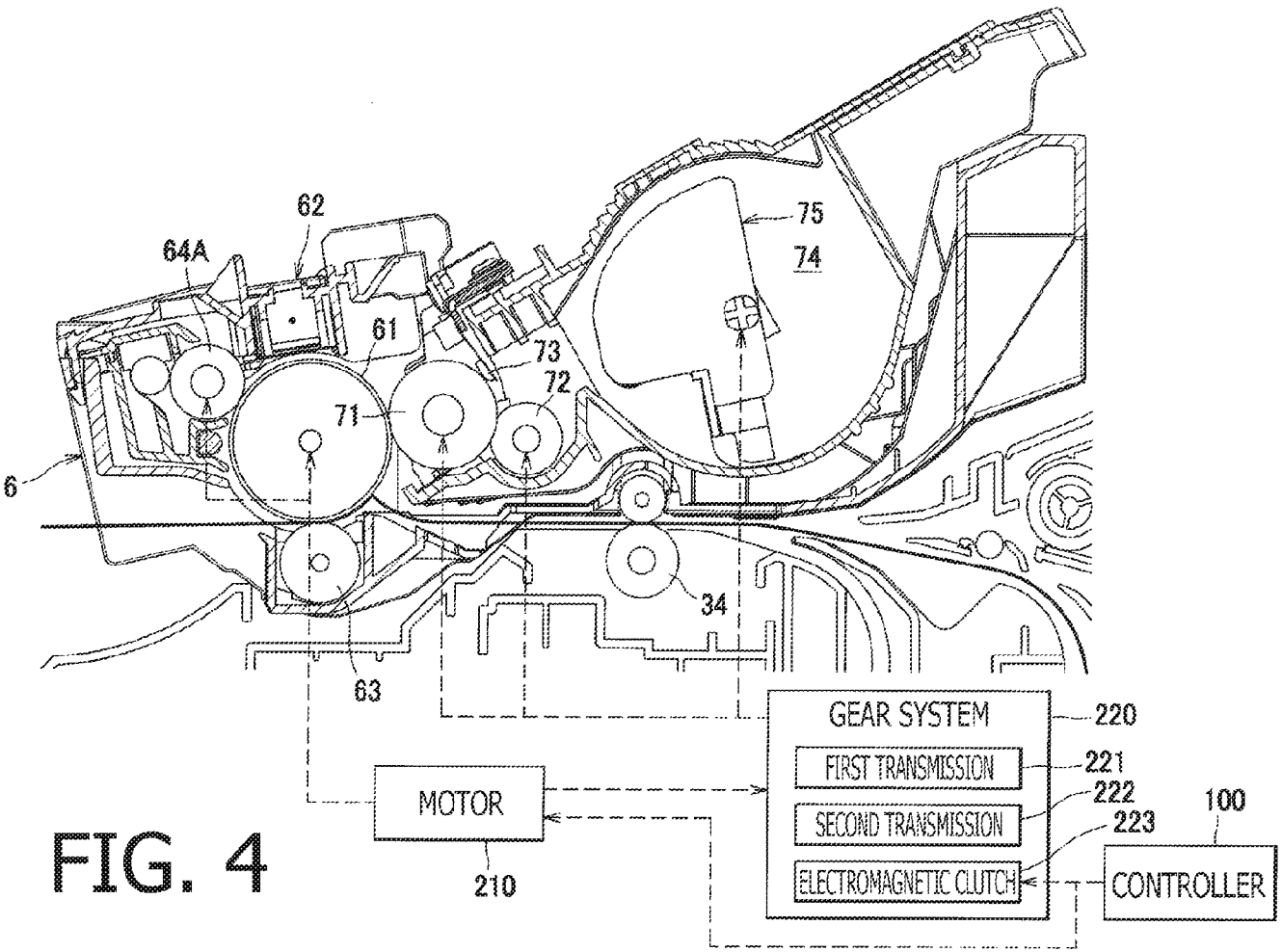
FIG. 4 is an illustrative view of connection of the devices in the processor cartridge with a motor, a gear system, and the controller in the laser printer according to the exemplary embodiment of the present disclosure.

Hereinafter, an exemplary configuration of a laser printer 1 being an image forming apparatus according to an embodiment of the present disclosure will be described with reference to the accompanying drawings. In the following description, directions concerning the laser printer 1 will be referred to in accordance with a user's ordinary position to use the laser printer 1, as indicated by arrows in FIGS. 1 and 2. For example, a viewer's right-hand side appearing in FIG. 1 is referred to as a front side of the laser printer 1, and a left-hand side in FIG. 1 opposite from the front side is referred to as a rear side. A side which corresponds to the viewer's nearer side is referred to as a left-hand side for the user, and an opposite side from the right, which corresponds to the viewer's farther side is referred to as a right-hand side for the user. An up-down direction in FIG. 1 corresponds to a vertical direction of the laser printer 1. A front-to-rear or rear-to-front direction may be referred to as a front-rear direction. Further, directions of the drawings in FIGS. 2-4 are similarly based on the orientation of the laser printer 1 as defined above and correspond to those with respect to the laser printer 1 shown in FIG. 1.

As shown in FIG. 1, the laser printer 1 includes a main body 2, an image forming unit G to form an image on a sheet S, and a sheet feeder 3 to feed the sheet S to the image forming unit G.

The sheet feeder 3 is disposed in a lower position in the main body 2 and includes a feeder tray 31, a sheet-pressing plate 32, a feeder device 33, and a registration roller 34. In the sheet feeder 3, the sheets S set in the feeder tray 31 are lifted upward by the sheet-pressing plate 32 and fed one-by-one by the feeder device 33 to the image forming unit G.

The image forming unit G includes an exposure device 4, a processor cartridge 5, and a fixing device 8.

The exposure device 4 is disposed in an upper position in the main body 2 and includes a laser emitter (not shown), polygon mirrors, lenses, and reflection mirrors, which may be shown but unsigned. In the exposure device 4, a laser beam, indicated in double-dotted line in FIG. 1, is emitted at a surface of a photosensitive drum 61 in the processor cartridge 5 via the polygon mirrors, the lenses, and the reflection mirrors so that the surface of the photosensitive drum 61 is selectively exposed to the laser beam.

The processor cartridge 5 is disposed in a lower position with respect to the exposure device 4. The processor cartridge 5 is detachably attached to the main body 2 through an opening, which may be exposed when a front cover 21 of the main body 2 is open. The processor cartridge 5 includes a drum unit 6 and a developer unit 7. The drum unit 6 includes the photosensitive drum 61, a scorotron charger 62, and a transfer roller 63. The developer unit 7 includes a developer roller 71, a supplier roller 72, and a toner-spreader blade 73, a toner container 74 to contain positively-chargeable toner being a developer agent, and an agitator 75 to stir the toner in the toner container 74.

In the processor cartridge 5, as the photosensitive drum 61 rotates, a surface of the photosensitive drum 61 is electrically evenly charged by the charger 62 and partly exposed to the laser beam emitted from the exposure device 4 so that the areas exposed to the laser beam form an electrostatic latent image according to image data, and the electrostatic latent image is carried on the surface of the photosensitive drum 61. Meanwhile, in areas that are not exposed to the laser beam, no electrostatic latent image is formed. The agitator 75 rotates in the toner container 74 to stir the toner and conveys the stirred toner toward the developer roller 71. The supplier roller 72 arranged to contact the developer roller 71 rotates along with the developer roller 71 and supplies the toner discharged out of the toner container 71 by the agitator 75 to the developer roller 71. The developer roller 71 is arranged to contact the toner-spreader blade 73, and as the developer roller 71 rotates, the toner-spreader blade 73 flattens the toner evenly on a surface of the developer roller 71 so that the toner is carried on the surface of the developer roller 71 in a layer.

Thereafter, in the developer unit 7, the toner carried on the developer roller 71 is supplied to the electrostatic latent image on the photosensitive drum 61 to visualize the electrostatic latent image and develop a toner image on the photosensitive drum 61. The sheet S fed by the sheet feeder 3 is carried to a position between the photosensitive drum 61 and the transfer roller 63 so that the toner image on the photosensitive drum 61 is transferred onto the sheet S. Meanwhile, the unexposed areas in the photosensitive drum 61, in which no electrostatic latent image was formed, may be kept from adherence of the toner.

The fixing device 8 is disposed in a rearward position with respect to the processor cartridge 5 and includes a heating unit 81 and a pressure roller 82. The heating unit 81 includes a halogen heater 81A, a fuser belt 81B, and a nipper board 81C. The pressure roller 82 is arranged to nip the fuser belt 81B in conjunction with the nipper board 81C of the heating unit 81. The fixing device 8 conveys the sheet S, onto which the toner image is transferred, through the position between the heating unit 81 and the pressure roller 82 so that the toner image on the sheet S is fused and fixed thereon. The sheet S with the toner image fixed thereon is conveyed by an ejection roller 23 to be ejected out of the main body 2 and placed on an ejection tray 22.

As shown in FIG. 2, the processor cartridge 5, in particular the drum unit 6 in the processor cartridge 5, includes a cleaning unit 64, a neutralizing lamp 90, a drum frame 200, further to the photosensitive drum 61, the charger 62, and the transfer roller 63. The charger 62 may include a charging wire 62A and a grid electrode 62B, which is arranged in a position between the charging wire 62A and the photosensitive drum 61.

The photosensitive drum 61 includes a drum body 61B, which is conductive and formed in a cylindrical shape, a photosensitive layer (unsigned) on an outer circumference of the drum body 61B, and a shaft 61A, which is conductive with the drum body 61B and is grounded. Meanwhile, the charger 62 is arranged in an upper position with respect to the photosensitive drum 61 to face the photosensitive drum 61, and the transfer roller 63 is arranged in a lower position with respect to the photosensitive drum 61 to contact the photosensitive drum 61. The developer roller 71 in the developer unit 7 is arranged to contact the photosensitive drum 61 at a position downstream from a position, where the photosensitive drum 61 and the charger 62 face each other, and upstream from a position, where the photosensitive drum 61 and the transfer roller 63 face each other, with regard to a rotating direction of the photosensitive drum 61 indicated by arrows in FIG. 2.

The cleaning unit 64 collects residues including residual toner and dust from the outer circumference of the photosensitive drum 61 after the transfer of the toner image from the photosensitive drum 61 to the sheet S. The cleaning unit 64 includes a cleaning roller 64A, a collecting roller 64B, a scraper 64C, and a cleaner frame 64D to support the cleaning roller 64A and the other members. The cleaning roller 64A is arranged downstream from the position, where the photosensitive drum 61 and the transfer roller 63 face each other, and upstream from the position, where the photosensitive drum 61 and the charger 62 face each other, with regard to the rotating direction indicated by arrows in FIG. 2, and in a substantially proximate position to collect the residues from the photosensitive drum 61.

The cleaning unit 64 removes the residues from the photosensitive drum 61 by the cleaning roller 64A and collects the residues adhered to the cleaning roller 64A by the collecting roller 64B. Further, the residues adhered to the collecting roller 64B are scraped off from the collecting roller 64B by the scraper 64C and stored in a residue container 64E, which is formed in the cleaner frame 64D.

The neutralizing lamp 90 includes an emitter 91, which is arranged to face the surface of the photosensitive drum 61, to emit light onto the surface of the photosensitive drum 61 to reduce electric charges remaining on the surface of the photosensitive drum 61 after the image transfer. The emitter 91 of the neutralizing lamp 90 is arranged upstream from the position, where the photosensitive drum 61 and the transfer roller 63 face each other, and upstream from the position, where the photosensitive drum 61 and the cleaning roller 64A face each other, with regard to the rotating direction of the photosensitive drum 61, to face the photosensitive drum 61.

The drum frame 200 being a frame in the drum unit 6 supports the photosensitive drum 61 and the transfer roller 63 rotatably and the cleaning unit 64. Further, the drum frame 200 may support the developer unit 7, which may be detachably attached to the drum frame 200.

As shown in FIG. 1, in the main body 2, arranged are an interior temperature sensor SE1, a humidity sensor SE2, and a controller 100 (see FIG. 3).

The interior temperature sensor SE1 detects a temperature in the main body 2 and may be, for example, a thermistor. The interior temperature sensor SE1 is arranged in the main body 2 in a position between the fixing device 8 and the processor cartridge 5 with regard to the front-rear direction. Thus, the interior temperature sensor SE1 is disposed in the main body 2, outside the processer cartridge 5.

The humidity sensor SE2 may be, for example, a sensor to detect relative humidity, and is arranged on an inner side with respect to an inlet port 24, which is formed in the main body 2. The humidity sensor SE2 may be arranged in a position, for example, to coincide with the inlet port 24. In other words, the humidity sensor SE2 may be exposed to the air entering the main body 2 through the inlet port 24. The humidity sensor SE2 may detect humidity of the air entering through the inlet port 24 so that the humidity of the air outside the main body 2 may be measured and determined. The temperature detected by the interior temperature sensor SE1 and the humidity detected by the humidity sensor SE2 are output to the controller 100.

The controller 100 includes a central processing unit (CPU), a random access memory (RAM), a read-only memory (ROM), and input/output circuits, which are not shown. The controller 100 may conduct a voltage-application controlling process, in which voltages are applied to electrical devices in the laser printer 1 including the charger 62, the developer roller 71, the supplier roller 72, the cleaning roller 64A, and the neutralizing lamp 90. Further, the controller 100 may control behaviors of a motor 210 and a gear system 220 (see FIG. 4), which are disposed in the main body 2.

The motor 210 is a source to provide driving force to the electrical devices including the photosensitive drum 61, the developer roller 71. In other words, the controller 100 may control the photosensitive drum 61 and the developer roller 71 to rotate, through the motor 210, in the voltage-application controlling process. The motor 210 may further provide driving force to the supplier roller 72, the agitator 75, and the cleaning roller 64A. The motor 210 is coupled to the photosensitive drum 61 and the cleaning roller 64A through predetermined numbers of gears and to the developer roller 71, the supplier roller 72, and the agitator 75 through the gear system 220, which may vary rotating velocities of developer roller 71, the supplier roller 72, and the agitator 75.

The gear system 220 is configured to switch gear ratios between the motor 210 and the developer roller 71. The gear system 220 may switch a peripheral velocity V of the developer roller 71 between a higher peripheral velocity V1 and a lower peripheral velocity V2, which is lower than the higher peripheral velocity V1 and faster than zero (0). Switching the peripheral velocities V of the developer roller 71 through the gear system 220 may switch a peripheral velocity ratio of the developer roller 71 with respect to the photosensitive drum 61. In the present embodiment, when the peripheral velocity V of the developer roller 71 is at the lower peripheral velocity V2, a peripheral velocity ratio of the developer roller 71 with respect to the photosensitive drum 61 is set to be less than 1; and when the peripheral velocity V of the developer roller 71 is at the higher peripheral velocity V1, the peripheral velocity ratio of the developer roller 71 with respect to the photosensitive drum 61 is set to be greater than or equal to 1. In the following description, the ratio of the peripheral velocity V of the developer roller 71 with respect to the photosensitive drum 61 being less than 1 may be called as a lower peripheral velocity ratio, and the ratio of the peripheral velocity V of the developer roller 71 with respect to the photosensitive drum 61 being greater than or equal to 1 may be called as a higher peripheral velocity ratio.

The gear system 220 may include a first transmission 221, a second transmission 222, and an electromagnetic clutch 223. The first transmission 221 may transmit the driving force from the motor 210 to the developer roller 71 at a first gear ratio to rotate the developer roller 71 at the higher peripheral velocity V1. The second transmission 222 may transmit the driving force from the motor 210 to the developer roller 71 at a second gear ratio to rotate the developer roller 71 at the lower peripheral velocity V2. The electromagnetic clutch 223 may switch transmission paths for the driving force from the motor 210 to the developer roller 71 between the first transmission 221 and the second transmission 222. In the gear system 220, when the electromagnetic clutch 223 is turned off, the driving force from the motor 210 may be transmitted to the developer roller 71 through the second transmission 222; and when the electromagnetic clutch 223 is turned on, the driving force from the motor 210 may be transmitted to the developer roller 71 through the first transmission 221.

When the controller 100 conducts the voltage-application controlling process to apply a voltage to the charger 62, the controller 100 may apply a wire-voltage Vw to the charging wire 62A in the charger 62 in order to apply a positive grid-voltage Vg to the grid electrode 62B. Further, in order to apply a voltage to the developer roller 71, the controller 100 may apply a developer-voltage Vb, which is a positive voltage lower than the grid-voltage Vg, to the developer roller 71. Moreover, in the voltage-application controlling process, the controller 100 may control a voltage difference between the grid-voltage Vg and the developer-voltage Vb based on the peripheral velocity ratio of the developer roller 71 with respect to the photosensitive drum 61, the humidity, and the temperature. In other words, the controller 100 may control the voltage difference by running a program stored in a computer-readable storage medium, which is not shown.

In this regard, however, the electric potential on the surface of the photosensitive drum 61 may not necessarily be controlled by the grid-voltage Vg but may be controlled by the voltage applied to the charger-wire 62A.

The controller 100 may refer to a plurality of tables (see FIGS. 7A, 7B and 8A, 8B), which are prepared based on experimental results (see FIGS. 5A, 5B), and in which grid-voltages Vg and developer-voltages Vb in various temperature and humidity conditions are indicated, to determine the grid-voltage Vg and the developer-voltage Vb suitable for the instant environment.

Figure 5A:
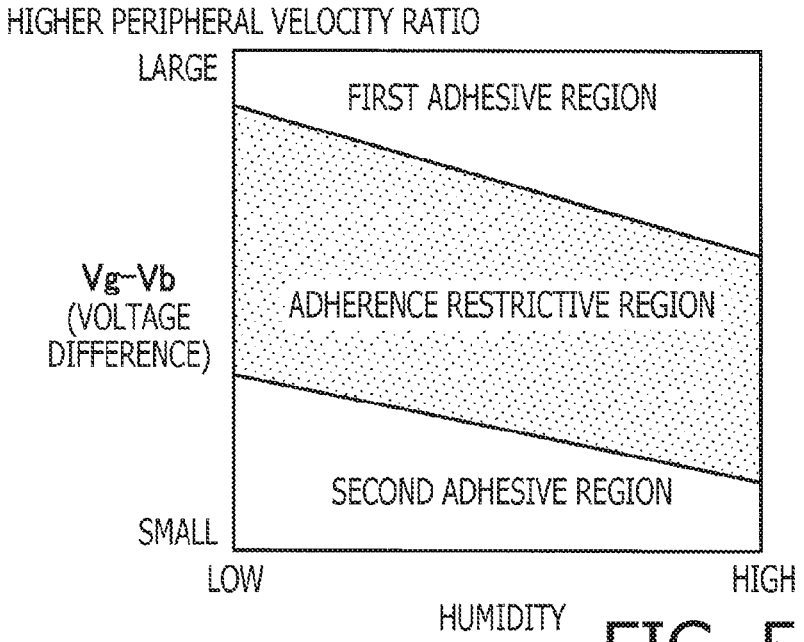
FIGS. 5A, 5B are graphs to illustrate a result of an experiment concerning interrelation among voltage differences, environmental conditions, and adhesiveness of a developer agent to an unexposed area when a peripheral velocity ratio is higher (FIG. 5A) and lower (FIG. 5B) in the laser printer according to the exemplary embodiment of the present disclosure.
Figure 5B:
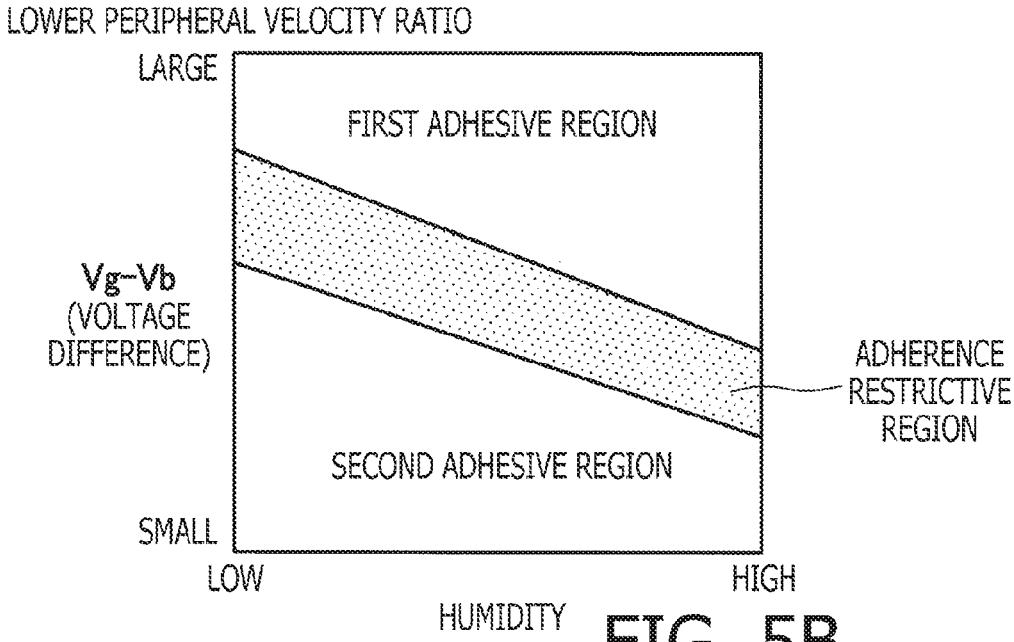

The graphs shown in FIGS. 5A and 5B each indicates interrelation among voltage differences (Vg-Vb), temperature (T) and humidity (H), and occurrence of adherence of the toner to an unexposed area in the photosensitive drum 61, which were obtained through experiments. The experimental results may be obtained, for example, by setting various values for the voltage difference, the temperature, and the humidity, and driving the photosensitive drum 61 and the developer roller 71 for a predetermined length of time. After the predetermined length of time of driving, adherence of the toner on the photosensitive drum 61 may be visually observed.

A first adhesive region shown in FIGS. 5A, 5B is a range, in which it is assumed that the toner adheres to the unexposed area of the photosensitive drum 61 due to reversed (negative) polarity of the toner while charge capacity of the toner is lowered under a condition where the voltage difference is larger. A second adhesive region shown in FIGS. 5A, 5B is a range, in which it is assumed that the toner adheres to the unexposed area due to a cause other than the lowered charge capacity of the toner under a condition where the voltage difference is smaller.

An adherence restrictive region shown in FIGS. 5A, 5B is a range, in which an amount of the toner adhered to the unexposed area is smaller than a predetermined amount. A maximum value and a minimum value for the voltage difference to define the adherence restrictive region may be determined based on conditions of the temperature. For example, the maximum value and the minimum value to define a range of the voltage differences in the adherence restrictive region may be determined by values that may restrain adherence of the toner even when, for example, the temperature is increased from a lower degree to a higher degree under a condition of lower humidity. In other words, for example, under the condition of the lower humidity, a range of the voltage differences, in which the toner may be restrained from adhering to the unexposed area regardless of the degrees of the temperature, may be defined by a boundary between the adherence restrictive region and the first adhesive region and a boundary between the adherence restrictive region and the second adhesive region.

Through the experiments, it was found that the adherence restrictive region is larger when the peripheral velocity ratio is higher than when the peripheral velocity ratio is lower. Further, it was found that the higher the humidity is, the smaller the maximum value and the minimum value for the voltage differences in the adherence restrictive region are, both when the peripheral velocity ratio is higher and lower.

The tables in FIGS. 6A, 6B show voltage differences, which are associated with various values (e.g., degrees and percentages) of temperature and humidity, and which may be defined in consideration of the experimental results shown in FIGS. 5A-5B and image-forming quality. Values of the voltage differences for the higher peripheral velocity ratio indicated in table in FIG. 6A are set to fall in the range of the larger adherence restrictive region shown in FIG. 5A and defined to be suitable to a preferable image-forming quality. For example, when the temperature is lower than 15 degrees C., the voltage difference may be set to be at a first voltage difference ΔV21 regardless of the value of humidity. When the temperature is 15 degrees C. or higher but lower than 20 degrees C., the voltage difference may be set at a second voltage difference ΔV22 which is greater than the first voltage difference ΔV21 regardless of the value of humidity. When the temperature is 20 degrees or higher, the voltage difference may be set at a third voltage difference ΔV23 which is greater than the second voltage difference ΔV22 regardless of the value of humidity.

Values of the voltage differences for the lower peripheral velocity ratio indicated in table in FIG. 6B are set to fall in the range of the smaller adherence restrictive region shown in FIG. 5B and defined to be suitable to a preferable image-forming quality. For example, when the humidity is lower than 30 percent, the voltage difference may be set at a fourth voltage difference ΔV15 regardless of the value of temperature. When the humidity is 30 percent or higher but lower than 50 percent, the voltage difference may be set at a fifth voltage difference ΔV14, which is smaller than the fourth voltage difference ΔV15.

When the humidity is 50 percent or higher but lower than 60 percent, the voltage difference may be set at the fifth voltage difference ΔV14 as long as the temperature is lower than 30 degrees C.; but when the temperature is 30 degrees or higher, the voltage difference may be set at a sixth voltage difference ΔV13, which is smaller than the fifth voltage difference ΔV14. When the humidity is 60 percent or higher but lower than 70 percent, the voltage difference may be set at the fifth voltage difference ΔV14 as long as the temperature is lower than 20 degrees C.; when the temperature is 20 degrees C. or higher but lower than 35 degrees C., the voltage difference may be set at the sixth voltage difference ΔV13; and when the temperature is 35 degrees C. or higher, the voltage difference may be set at a seventh voltage difference ΔV12, which is smaller than the sixth voltage difference ΔV13.

When the humidity is 70 percent or higher but lower than 80 percent, the voltage difference may be set at the fifth voltage difference ΔV14 as long as the temperature is lower than 10 degrees C.; when the temperature is 10 degrees C. or higher but lower than 20 degrees C., the voltage difference may be set at the sixth voltage difference ΔV13; when the temperature is 20 degrees C. or higher but lower than 30 degrees C., the voltage difference may be set at the seventh voltage difference ΔV12; and when the temperature is 30 degrees C. or higher, the voltage difference may be set at an eighth voltage difference ΔV11, which is smaller than the seventh voltage difference ΔV12. When the humidity is 80 percent or higher, the voltage difference may be set at the sixth voltage difference ΔV13 as long as the temperature is lower than 10 degrees C.; and when the temperature is 10 degrees or higher but lower than 30 degrees C., the voltage difference may be set at the seventh voltage difference ΔV12; and when the temperature is 30 degrees C. or higher, the voltage difference may be set at the eighth voltage difference ΔV11.

Thus, the table in FIG. 6B, which may be used when the peripheral velocity ratio is lower, defines smaller voltage differences for higher values of humidity, and larger voltage differences for lower values of humidity. Therefore, according to the table in FIG. 6B, the higher the humidity is, the smaller the voltage difference is. In other words, a voltage difference at a predetermined value of temperature is defined to be smaller for higher values of humidity. In this regard, the expression a voltage difference being smaller for higher values of humidity may not necessarily mean that the humidity and the voltage difference are in direct proportion but may mean that the voltage difference falls on a value corresponding to the predetermined value of humidity or a higher value. Likewise, in the following description, unless otherwise noted, the similar expression such as "one thing being smaller for another thing being higher," "the smaller one thing is, the higher another thing is," and the like, should be interpreted in the same manner as explained above.

The table in FIG. 6B for the lower peripheral velocity ratio defines smaller voltage differences for higher degrees of temperature as long as the humidity is 50 percent or higher. More specifically, the voltage differences at a predetermined value of humidity, which is for example 50 percent or higher, may be smaller for higher values of temperature.

The fourth voltage difference ΔV15 and the fifth voltage difference ΔV14 for the lower peripheral velocity ratio may be defined to be greater than the maximum value of the voltage difference for the greater peripheral velocity ratio, i.e., greater than the third voltage difference ΔV23 (see FIG. 6A). Therefore, for example, when the humidity is lower than 50 percent, the fourth and fifth voltage differences ΔV14, ΔV15 may be greater than the voltage differences ΔV21-ΔV23 for the greater peripheral velocity ratio.

Meanwhile, a difference between the fourth voltage difference ΔV15 being the maximum value and the eighth voltage difference ΔV11 being the minimum value for the lower peripheral velocity ratio may be greater than a difference between the third voltage difference ΔV23 being the maximum value and the first voltage difference ΔV21 being the minimum value for the higher peripheral velocity ratio. Further, the eighth voltage difference ΔV11 being the minimum value among the voltage differences for the lower peripheral velocity ratio may be smaller than the first voltage difference ΔV21 being the minimum value among the voltage differences for the higher peripheral velocity ratio.

The controller 100 may control the grid-voltage Vg and the developer-voltage Vb so that the voltage difference should shift in compliance with the values defined in the tables in FIGS. 6A-6B based on the environmental condition, e.g., the peripheral velocity ratio, temperature, and humidity. Specifically, the controller 100 may control the grid-voltage Vg and the developer-voltage Vb with reference to a first charger table and a second charger table, which are shown in FIGS. 7A and 7B, and a first developer table and a second developer table, which are shown in FIGS. 8A and 8B, respectively. The first and second charger tables shown in FIGS. 7A, 7B and the first and second developer tables shown in FIGS. 8A, 8B may be stored in a memory device, which is not shown, in the laser printer 1. The first and second charger tables shown in FIGS. 7A, 7B are tables that define the grid-voltage Vg on the basis of the condition of the peripheral velocity ratio, temperature, and humidity, and may be derived from the tables shown in FIGS. 6A, 6B, respectively. The first and second developer tables shown in FIGS. 8A, 8B are tables that define the developer-voltage Vb on the basis of the condition of the peripheral velocity ratio, temperature, and humidity, and may be derived from the tables shown in FIGS. 6A, 6B, respectively.

For example, the first charger table shown in FIG. 7A is a table that defines the grid-voltages Vg for the higher peripheral velocity ratio. According to the first charger table, the grid-voltage Vg may be set at a constant value, e.g., a third grid-voltage Vg3, regardless of temperature or humidity. The second charger table shown in FIG. 7B is a table that defines the grid-voltages Vg for the lower peripheral velocity ratio. According to the second charger table, the grid-voltage Vg may be set at the third grid-voltage Vg3 regardless of the temperature as long as the humidity is lower than 50 percent.

When the humidity is 50 percent or higher but lower than 60 percent, the grid-voltage Vg may be set at the third grid-voltage Vg3 as long as the temperature is lower than 30 degrees C. and may be set at a second grid-voltage Vg2, which is smaller than the third grid-voltage Vg3, when the temperature is 30 degrees C. or higher. When the humidity is 60 percent or higher but lower than 70 percent, the grid-voltage Vg may be set at the third grid-voltage Vg3 as long as the temperature is lower than 20 degrees C. and may be set at the second grid-voltage Vg2 when the temperature is 20 degrees C. or higher.

When the humidity is 70 percent or higher but lower than 80 percent, the grid-voltage Vg may be set at the third grid-voltage Vg3 as long as the temperature is lower than 10 degrees C.; at the second grid-voltage Vg2 when the temperature is 10 degrees C. or higher but lower than 30 degrees C.; and at a first grid-voltage Vb1, which is smaller than the second grid-voltage Vg2, as long as the temperature is 30 degrees C. or higher. When the humidity is 80 percent or higher, the grid-voltage Vg may be set at the second grid-voltage Vg2 as long as the temperature is lower than 30 degrees C. but may be set at the first grid-voltage Vg1 when the temperature is 30 degrees C. or higher.

Thus, the second charger table shown in FIG. 7B defines the smaller grid-voltages Vg for the higher values of humidity. In other words, at a predetermined value of temperature, the higher the humidity is, the smaller the grid-voltage Vg is.

For another example, the first developer table shown in FIG. 8A is a table that defines the developer-voltages Vb for the higher peripheral velocity ratio. According to the first developer table, the developer-voltage Vb may be set at a constant value, e.g., a sixth developer-voltage Vb6, regardless of the humidity as long as the temperature is lower than 15 degrees C.

When the temperature is 15 degrees C. or higher but lower than 20 degrees C., the developer-voltage Vb may be set at a fifth developer-voltage Vg5, which is smaller than the sixth developer-voltage Vb6, regardless of the humidity. When the temperature is 20 degrees C. or higher, the developer-voltage Vb may be set at a fourth developer-voltage Vb4, which is smaller than the fifth developer-voltage Vb5, regardless of the humidity.

The second developer-table shown in FIG. 8B is a table that defines the developer-voltages Vb for the lower peripheral velocity ratio. According to the second developer table, the developer-voltage Vb may be set at a first developer-voltage Vb 1, which is lower than the fourth developer-voltage Vb4 regardless of the temperature as long as the humidity is lower than 30 percent. When the humidity is 30 percent or higher but lower than 60 percent, the developer-voltage Vb may be set at a second developer-voltage Vb2, which is higher than the first developer-voltage Vb1 and lower than the fourth developer-voltage Vb4, regardless of the temperature.

When the humidity is 60 percent or higher but lower than 70 percent, the developer-voltage Vb may be set at the second developer-voltage Vb2 as long as the temperature is lower than 35 degrees C. and may be set at a third developer-voltage Vb3, which is higher than the second developer-voltage Vb2 and lower than the fourth developer-voltage Vb4, as long as the temperature is 35 degrees C. or higher. When the humidity is 70 percent or higher but lower than 80 percent, the developer-voltage Vb may be set at the second developer-voltage Vb2 as long as the temperature is lower than 20 degrees C. and may be set at the third developer-voltage Vb3 when the temperature is 20 degrees C. or higher. When the humidity is 80 percent or higher, the developer-voltage Vb may be set at the second developer-voltage Vd2 as long as the temperature is lower than 10 degrees C. and may be set at the third developer-voltage Vb3 when the temperature is 10 degrees C. or higher.

Thus, the second charger table shown in FIG. 8B defines the smaller developer-voltages Vb for the higher values of humidity. In other words, at a predetermined value of temperature, the higher the humidity is, the smaller the developer-voltage Vb is. Further, the third developer-voltage Vb3 being the maximum value among the developer-voltages Vb for the lower peripheral velocity ratio is smaller than the fourth developer-voltage Vb4 being the minimum value of the developer-voltages Vb for the higher peripheral velocity ratio. Therefore, the first-third developer-voltages Vb1-Vb3 for the lower peripheral velocity ratio are lower than the fourth to sixth developer-voltages Vb4-Vb6 for the higher peripheral velocity ratio.

Thus, the controller 100 may designate values for the grid-voltage Vg and the developer-voltage Vb based on the condition of the peripheral velocity ratio, temperature, and humidity, with reference to the tables shown in FIGS. 7A-7B and 8A-8B, and may change the peripheral velocity ratios by switching the electromagnetic clutch 223 in the gear system 220 on or off. Further, the controller 100 may change the lower peripheral velocity ratio to the higher peripheral velocity ratio by shifting the electromagnetic clutch 223 from off to on and thereafter designate the grid-voltage Vg and the developer-voltage Vb anew based on the switched higher peripheral velocity ratio.

Next, a flow of steps in a method to designate the grid-voltage Vg and the developer-voltage Vb by the controller 100 will be described. In the method described below, the grid-voltage Vg and the developer-voltage Vb may be switched on or off, and the peripheral velocity ratios may be switched, at timings in compliance with known protocols; therefore, description concerning those timings are herein omitted.

Figure 9:
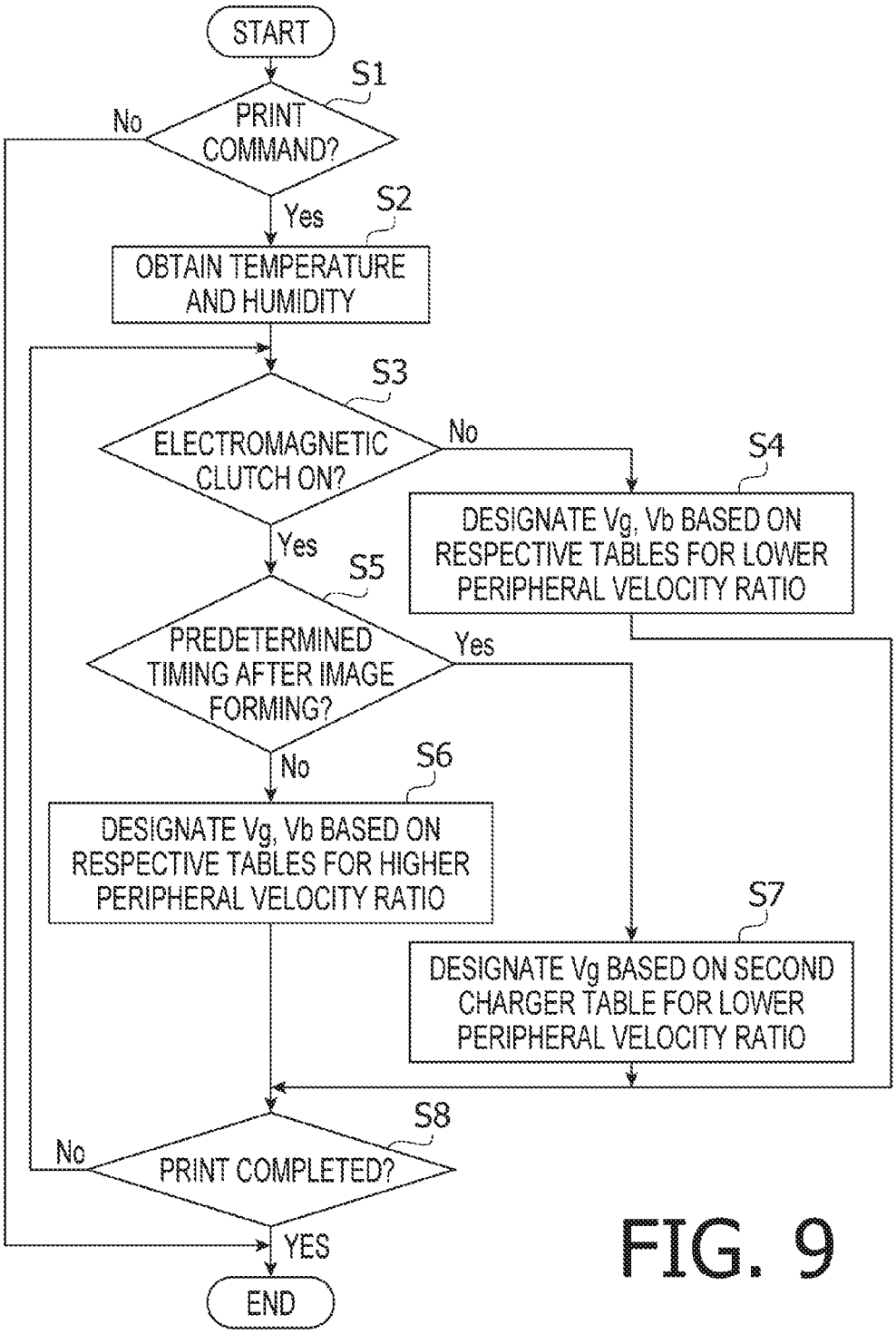
FIG. 9 is a flowchart to illustrate a flow of actions to be conducted by the controller in the laser printer according to the exemplary embodiment of the present disclosure.

The grid-voltage Vg and the developer-voltage Vb may be designated through a process including steps shown in FIG. 9, which may be conducted by the controller 100. In S1, the controller 100 determines whether a print command, which is a command to activate a printing operation, is entered. When the controller 100 determines that the print command was entered (S1: YES), in S2, the controller 100 obtains a value of temperature and a value of humidity from the interior temperature sensor SE1 and the humidity sensor SE2, respectively.

Following S2, in S3, the controller 100 determines whether the electromagnetic clutch 223 is on. When the controller 100 determines that the electromagnetic clutch 223 is not on (S3: NO), in S4, the controller 100 designates the grid-voltage Vg and the developer-voltage Vb based on the second charger table and the second developer table prepared for the lower peripheral velocity ratio and based on the temperature and humidity obtained in S2.

Meanwhile, in S3, when the controller 100 determines the electromagnetic clutch 223 being on (S3: YES), in S5, the controller 100 further determines whether it is predetermined timing with regard to the image forming operation. In particular, the controller 100 determines whether it is predetermined timing when the grid-voltage Vg should be lowered to a voltage lower than the grid-voltage Vg during the image forming operation after completion of forming images on a number of sheet(s) S as commanded in the print command. The timing to lower the grid-voltage Vg may be anytime as long as it is later than completion of conveying the last sheet S with the image forming thereon through the intermediate position between the photosensitive drum 61 and the transfer roller 63.

In S5, when the controller 100 determines that it is not the predetermined timing (S5: NO), in S6, the controller 100 designates the grid-voltage Vg and the developer-voltage Vb based on the first charger table and the first developer table prepared for the higher peripheral velocity ratio and based on the temperature and humidity obtained in S2. The voltages Vg, Vb may be controlled to be switched in an order: the grid-voltage Vg earlier, and the developer-voltage Vb later for a predetermined length of time, so that the developer-voltage Vb should be changed when a part of the photosensitive drum 61, of which surface potential has been changed earlier by the change in the grid-voltage Vg, reaches the developer roller 71.

In S5, when the controller 100 determines that it is the predetermined timing (S5: YES), in S7, the controller 100 designates the grid-voltage Vg alone based on the charger table prepared for the lower peripheral velocity ratio and based on the temperature and humidity obtained in S2. In S7, the developer-voltage Vb is not changed.

Following one of S4, S6, and S7, in S8, the controller 100 determines whether a print-controlling operation has been completed. The print-controlling operation may include a flow of control, which may start when the print command is entered, to form the images on the number of sheets S as commanded by the print command, and may end when a known cleaning operation after the image forming operation is completed.

In S8, when the controller 100 determines that the print-controlling operation is not completed (S8: NO), the flow returns to S3. On the other hand, when the controller 100 determines that the print-controlling operation is completed (S8: YES), or in S1, when the controller 100 determines that no print command is entered (S1: NO), the controller 100 ends the flow.

Next, behaviors of the controller 100, which may be conducted under a condition of high temperature and high humidity, for example, when a temperature is 40 degrees C. or higher and humidity is 80 percent or higher, will be described with reference to a timing chart shown in FIG. 10.

Figure 10:
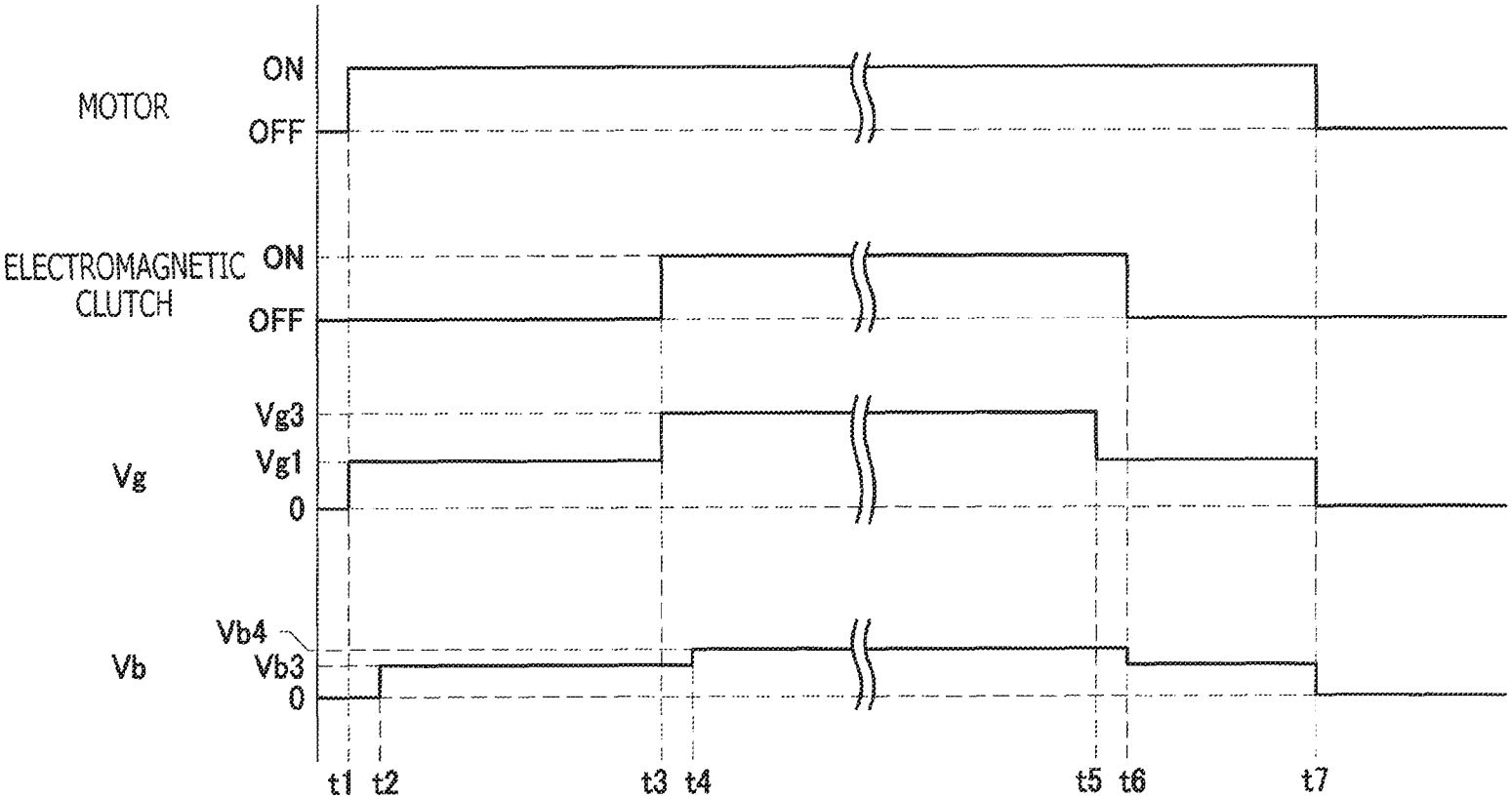
FIG. 10 is a time chart to illustrate control of the voltages by the controller in the laser printer according to the exemplary embodiment of the present disclosure.

As shown in FIG. 10, when the controller 100 receives the print command at timing ti, the controller 100 supplies power to the motor 21 to drive the motor 210. Further, the controller 100 designates the grid-voltage Vg and the developer-voltage Vb in S4 (see FIG. 9) and starts applying the grid-voltage Vg to the grid electrode 62B. For example, the controller 100 may designate the first grid-voltage Vg1 with reference to the second charger table (see FIG. 7B) and the second developer-voltage Vb3 with reference to the second developer table (see FIG. 8B).

After a predetermined length of time since the start of applying the grid-voltage Vb, at timing t2, the controller 100 starts applying the developer-voltage Vb designated at timing ti, i.e., the third developer-voltage Vb3, to the developer roller 71. Thereby, the voltage difference between the grid-voltage Vg and the developer-voltage Vb should be the eighth voltage difference ΔV11, which is the minimum value among the voltage differences defined in the table shown in FIG. 6B for the lower peripheral velocity ratio.

Thereafter, at timing t3, when the image forming operation should start, the controller switches the electromagnetic clutch 223 on and, in S6 (see FIG. 9), designates the grid-voltage Vg and the developer-voltage Vb. For example, the controller 100 may designate the third grid-voltage Vg3, which is higher than the first grid-voltage Vg1, with reference to the first charger table (see FIG. 7A) and the fourth developer-voltage Vb4, which is higher than the third developer-voltage Vb3, with reference to the first developer table (see FIG. 8A). In this regard, the grid-voltage Vg is changed earlier, and later, after a predetermine length of time, the developer-voltage Vb is changed. Thereby, along with the electromagnetic clutch 223 turning on, the grid-voltage Vg increases from the first grid-voltage Vg1 to the third grid-voltage Vg3 at timing t3, and after the predetermined length of time, i.e., at timing t4, the developer-voltage Vb is increased from the third developer-voltage Vb3 to the fourth developer-voltage Vb4.

The voltage difference at timing t4 is the third voltage difference ΔV23 (see FIG. 6A), which is the maximum value among the voltage differences defined in the table for the higher peripheral velocity shown in FIG. 6A. Thereby, the voltage difference ΔV23 for the higher peripheral velocity ratio larger than the voltage difference ΔV11 for the lower peripheral velocity ratio.

At timing t5, at the predetermined timing after completion of the image forming operation, the controller 100 designates the grid-voltage Vg alone in S7 (see FIG. 9). For example, the controller 100 may designate the first grid-voltage Vg1 with reference to the second charger table shown in FIG. 7B. Thereby, at timing t5, the grid-voltage Vg is lowered from the third grid-voltage Vg3 to the first grid-voltage Vg1.

Thereafter, at timing t6, when the electromagnetic clutch 223 is switched off, the controller 100 designates the grid-voltage Vg and the developer-voltage Vb in S4 (see FIG. 7). For example, the controller 100 may designate the same grid-voltage Vg as the grid-voltage Vg designated at timing t5 and may designate the third developer-voltage Vb3 with reference to the second developer table shown in FIG. 8B. Thereby, at timing t6, the developer-voltage Vb is lowered from the fourth developer-voltage Vb4 to the third developer-voltage Vb3.

Thereafter, at timing t7, in response to completion of the cleaning operation, the controller 100 stops power supply to the motor 210 and stops applying the voltages to the grid electrode 62b and the developer roller 71.

According to the present disclosure, even after the changes in the peripheral velocity ratios, temperature, and humidity, the grid-voltage Vb and the developer-voltage Vb may be designated based on the changed condition so that the voltage difference may be controlled at the preferable values. Therefore, the toner may be restrained from adhering to the unexposed area on the photosensitive drum 61 regardless of the condition changes.

According to the present disclosure, when the peripheral velocity ratio is lower, the voltage difference is controlled to be smaller for the higher values of humidity so that the toner may be effectively prevented from adhering to the unexposed area on the photosensitive drum 61. Meanwhile, a chargeable amount of the toner may tend to be lowered in higher humidity, and, when the peripheral velocity ratio is lowered while the toner is less chargeable, a first-type phenomenon, in which toner adheres to an unexposed area in the photosensitive drum 61, may tend to occur. It is recognized that the first-type phenomenon may be likely to occur due to the polarity of the toner being reversed while the toner is less chargeable by the higher humidity and the voltage difference is larger. In this regard, according to the control described above, the voltage difference is controlled to be lower when the peripheral velocity ratio is lower and the humidity is higher. Therefore, the first-type phenomenon may be preferably restrained.

According to the present disclosure, a difference between the maximum value and the minimum value in the voltage differences for the higher peripheral velocity ratio i.e., ΔV15−ΔV11, is greater than a difference between the maximum value and the minimum value in the voltage differences for the lower peripheral velocity ratio, i.e., ΔV23−ΔV21. Therefore, when the peripheral velocity ratio is lower, the voltage difference may be designated among various values to be optimized for the environmental factors, and the first-type phenomenon may be preferably restrained. In this regard, it may be noted that, when the peripheral velocity ratio is lower, adherence of the toner may likely be affected more largely by the change of the chargeable amount of the toner. Therefore, by providing the wider range of options for the voltage difference when the peripheral velocity ratio is lower than the range of options for the higher peripheral velocity ratio, the voltage difference may be designated more preferably in accordance with the larger change of the chargeable amount in the toner, and the first-type phenomenon may be more preferably restrained.

According to the present disclosure, the grid-voltage Vg for the lower peripheral velocity ratio is controlled to be lower when humidity is higher. Therefore, compared to a configuration, for example, in which the voltage difference is lowered while the grid-voltage is not lowered, electric discharge from the charger 62 to the photosensitive drum 61 may be restrained.

According to the present disclosure, when the humidity is lower than 50 percent, the voltage difference for the lower peripheral velocity is enlarged to be larger than the voltage difference for the higher peripheral velocity ratio; therefore, the toner may be preferably prevented from adhering to the unexposed area of the photosensitive drum 61. Meanwhile, in lower humidity, when the peripheral velocity ratio is lower, and if the voltage difference is set to be smaller, a second-type phenomenon, in which the toner tends to adhere to the unexposed area in the photosensitive drum 61 due to a cause other than the lowered chargeable amount of toner, may likely to occur. It is recognized that the second-type phenomenon may be likely to occur due to a cause that, when the peripheral velocity ratio is lower, frictional force in the toner held between the photosensitive drum 61 and the developer roller 71 tends to increase; and the chargeable amount of the toner, which draws the charge from the photosensitive drum 61, may increase while the surface potential of the photosensitive drum 61 may be lowered to be drained to the toner; and a small voltage difference may be reduced to be even smaller. In this regard, according to the configuration described above, when humidity is lower, the voltage difference is enlarged for the lower peripheral velocity compared to the voltage difference for the higher peripheral velocity; therefore, the second-type phenomenon may be preferably restrained.

According to the present disclosure, the developer-voltage Vb for the lower peripheral velocity ratio is controlled to be lower than the developer-voltage Vb for the higher peripheral velocity. Therefore, compared to a configuration, in which, for example, the voltage difference is enlarged while the developer-voltage is not lowered, increase of the grid-voltage Vb may not be necessary, and electric discharge from the charger 62 to the photosensitive drum 61 may be restrained.

According to the present disclosure, the voltage difference may be changed after the peripheral velocity ratio is changed from the lower ratio to the higher ratio, the first-type and the second-type phenomena may be preferably restrained. Meanwhile, when the peripheral velocity ratio is lower, the first-type phenomenon and/or the second-type phenomenon may likely to occur more often compared to the higher peripheral velocity ratio (see FIG. 5). In this regard, it may be noted that the first-type phenomenon occurs in the first adhesive region, and the second-type phenomenon occurs in the second adhesive region. Therefore, for example, if the voltage difference is changed before the peripheral velocity ratio is switched from the lower ratio to the higher ratio, the voltage difference may fall in the first adhesive region or the second adhesive region, and it may be likely that the first-type or second-type phenomenon occurs. In contrast, by changing the voltage difference after changing the peripheral velocity ratios from lower to higher, the voltage difference may be changed after enlarging the adherence restrictive region. Therefore, the first-type and the second type phenomena may be preferably restrained.

According to the present disclosure, when the peripheral velocity is lower, and when humidity is 50 percent or higher, the voltage difference is controlled to be smaller for a higher value of humidity; therefore, the first-type phenomenon may be preferably restrained. In this regard, when the humidity is thus higher, the toner may tend to be less easily chargeable for higher temperature. With the chargeable amount of the toner being lowered, when the peripheral velocity ratio is lowered, the voltage difference may be enlarged, and the first-type phenomenon may likely to occur. However, according to the configuration in the embodiment described above, the voltage difference is reduced for the higher temperature when the peripheral velocity ratio is lower and the humidity is 50 percent or higher so that the first-type phenomenon may be preferably restrained.

Although an example of carrying out the invention has been described, those skilled in the art will appreciate that there are numerous variations and permutations of the image forming apparatus and the controlling method that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters.

Figure 11:
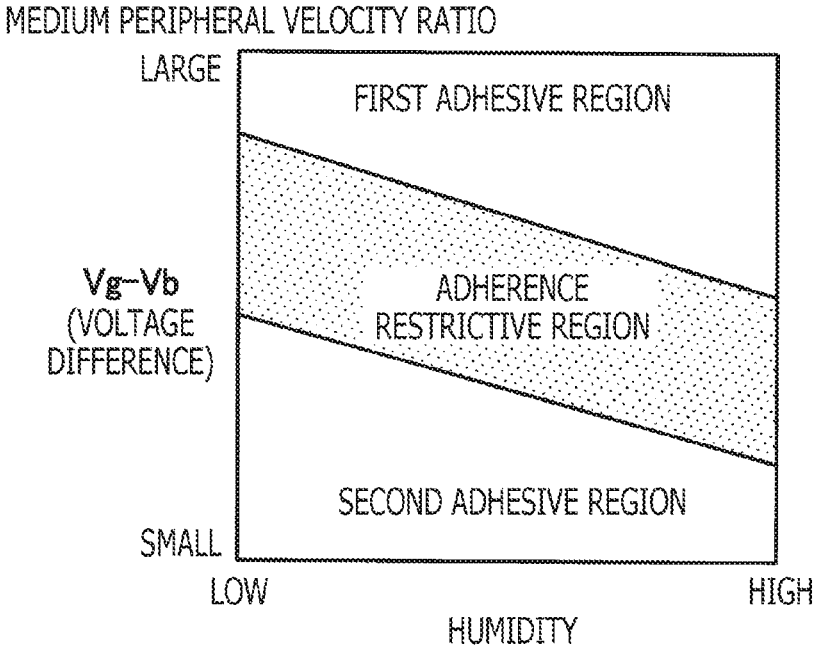
FIG. 11 is a graph to illustrate a result of the experiment concerning interrelation among voltage differences, environmental conditions, and adhesiveness of a developer agent to an unexposed area when the peripheral velocity ratio is intermediate in the laser printer according to the exemplary embodiment of the present disclosure.

For example, the peripheral velocity ratios may not necessarily be switchable between the two phases but may be switchable among three (3) or more phases. For example, the peripheral velocity ratio may be switchable to a medium peripheral velocity ratio (see FIG. 11), which is higher than the above-described lower peripheral velocity ratio and lower than the above-described higher peripheral velocity ratio. In this regard, it should be noted that, as shown in FIGS. 5 and 11, the adherence restrictive region should be enlarged to be larger as the peripheral velocity ratio is increased to be higher. Therefore, by defining and designating a grid-voltage and a developer-voltage that fall in the range of the adherence restrictive region for the medium peripheral velocity ratio, the toner may be restrained from adhering to the unexposed area of the photosensitive drum 61.

For another example, the photosensitive drum 61 may be replaced with a photosensitive belt.

For another example, the charger 62 may not necessarily have the scorotoron-typed charger but may have a corotron-typed charger or a charger roller that may contact the photosensitive member.

For another example, the present disclosure may not necessarily be applied to a laser printer such as the laser printer 1 described above but may be applied to, for example, a copier and a multifunction peripheral.

For another example, the developer agent may not necessarily be limited to the positively chargeable toner but may include a negatively-chargeable toner. When the negatively-chargeable toner is employed, the polarity of the grid-voltage and the developer-voltage may be inverted to negative to comply with the negatively-chargeable toner, but absolute values of the grid-voltage and the developer-voltage may be maintained the same as those in the grid-voltage and the developer-voltage of the above-described embodiment.

What is claimed is:

1. An image forming apparatus, comprising:

a photosensitive member;

a charger configured to charge the photosensitive member;

a developer roller configured to contact the photosensitive member and supply a developer agent to the photosensitive member;

a humidity sensor configured to detect humidity; and a controller configured to execute a voltage-application controlling process, in which the controller controls the photosensitive member and the developer roller to rotate, applies a charger-voltage to the charger, and applies a developer-voltage to the developer roller, wherein, in the voltage-application controlling process, the controller controls a voltage difference between the charger-voltage and the developer-voltage based on a peripheral velocity ratio of the developer roller with respect to the photosensitive member and the humidity.

2. The image forming apparatus according to claim 1, wherein, in the voltage-application controlling process, the controller controls the voltage difference to be smaller for higher humidity under a condition of the peripheral velocity ratio being less than 1.

3. The image forming apparatus according to claim 2, wherein a difference between a maximum value and a minimum value of the voltage difference for the peripheral velocity ratio being less than 1 is greater than a difference between a maximum value and a minimum value of the voltage difference for the peripheral velocity ratio being greater than or equal to 1.

4. The image forming apparatus according to claim 3, wherein the minimum value of the voltage difference for the peripheral velocity ratio being less than 1 is smaller than the minimum value of the voltage difference for the peripheral velocity ratio being greater than or equal to 1.

5. The image forming apparatus according to claim 1, wherein, in the voltage-application controlling process, the controller controls the charger-voltage to be smaller for higher humidity under a condition of the peripheral velocity ratio being less than 1.

6. The image forming apparatus according to claim 1, wherein, in the voltage-application controlling process, under a condition of the humidity being lower than a predetermined value, the controller controls the voltage difference for the peripheral velocity ratio being less than 1 to be greater than the voltage difference for the peripheral velocity ratio being greater than or equal to 1.

7. The image forming apparatus according to claim 6, wherein the developer-voltage for the peripheral velocity ratio being less than 1 is smaller than the developer-voltage for the peripheral velocity ratio being greater than or equal to 1.

8. The image forming apparatus according to claim 1, wherein, in the voltage-application controlling process, the controller changes the voltage difference after changing the peripheral velocity ratio from a value less than 1 to another value greater than or equal to 1.

9. The image forming apparatus according to claim 1, further comprising a temperature sensor configured to detect a temperature, wherein, in the voltage-application controlling process, the controller controls the voltage difference between the charger-voltage and the developer-voltage based on the peripheral velocity ratio, the humidity, and the temperature.

10. The image forming apparatus according to claim 9, wherein, in the voltage-application controlling process, the controller controls the voltage difference to be smaller for a higher temperature under a condition of the peripheral velocity ratio being less than 1 and the humidity being at a predetermined value or higher.

11. A method to control voltage application in an image forming apparatus, the image forming apparatus comprising a photosensitive member, a charger configured to charge the photosensitive member, and a developer roller configured to contact the photosensitive member and supply a developer agent to the photosensitive member, the method comprising:

controlling the photosensitive member and the developer roller to rotate; and controlling voltage application of a charger-voltage to the charger and a developer-voltage to the developer roller, wherein, during the control of the voltage application, a voltage difference between the charger-voltage and the developer-voltage is controlled based on a peripheral velocity ratio of the developer roller with respect to the photosensitive member and humidity.

12. The method according to claim 11, wherein, during the control of the voltage application, the voltage difference is controlled to be smaller for higher humidity under a condition of the peripheral velocity ratio being less than 1.

13. The method according to claim 12, wherein a difference between a maximum value and a minimum value of the voltage difference for the peripheral velocity ratio being less than 1 is greater than a difference between a maximum value and a minimum value of the voltage difference for the peripheral velocity ratio being greater than or equal to 1.

14. The method according to claim 13, wherein the minimum value of the voltage difference for the peripheral velocity ratio being less than 1 is smaller than the minimum value of the voltage difference for the peripheral velocity ratio being greater than or equal to 1.

15. The method according to claim 11, wherein, during the control of the voltage application, the charger-voltage is controlled to be smaller for higher humidity under a condition of the peripheral velocity ratio being less than 1.

16. The method according to claim 11, wherein, during the control of the voltage application, under a condition of the humidity being lower than a predetermined value, the voltage difference for the peripheral velocity ratio being less than 1 is controlled to be greater than the voltage difference for the peripheral velocity ratio being greater than or equal to 1.

17. The method according to claim 16, wherein the developer-voltage for the peripheral velocity ratio being less than 1 is smaller than the developer-voltage for the peripheral velocity ratio being greater than or equal to 1.

18. The method according to claim 11, wherein, during the control of the voltage application, the voltage difference is changed after the peripheral velocity ratio from a value less than 1 is changed to another value greater than or equal to 1.

19. The method according to claim 11, wherein, during the control of the voltage application, the voltage difference between the charger-voltage and the developer-voltage is controlled based on the peripheral velocity ratio, the humidity, and a temperature.

20. The method according to claim 19, wherein, during the control of the voltage application, the voltage difference is controlled to be smaller for a higher temperature under a condition of the peripheral velocity ratio being less than 1 and the humidity being at a predetermined value or higher.

* * * * *